US008963896B2

(12) United States Patent
Hsieh et al.

(10) Patent No.: US 8,963,896 B2
(45) Date of Patent: Feb. 24, 2015

(54) DOT INVERSION TFT ARRAY AND LCD PANEL

(75) Inventors: Min-Nan Hsieh, Hsinchu County (TW); Jian-Kao Chen, Hsinchu County (TW); Chin-Wei Lin, Hsinchu County (TW)

(73) Assignee: MStar Semiconductor, Inc., Hsinchu County (TW)

( * ) Notice: Subject to any disclaimer, the term of this patent is extended or adjusted under 35 U.S.C. 154(b) by 232 days.

(21) Appl. No.: 13/347,816

(22) Filed: Jan. 11, 2012

(65) Prior Publication Data

US 2012/0176351 A1 Jul. 12, 2012

(30) Foreign Application Priority Data

Jan. 11, 2011 (TW) ..... 100101016 A

(51) Int. Cl.
*G09G 3/36* (2006.01)
*G09G 5/00* (2006.01)

(52) U.S. Cl.
CPC ..... *G09G 3/3648* (2013.01); *G09G 3/3614* (2013.01); *G09G 2300/0426* (2013.01)
USPC ..... 345/204

(58) Field of Classification Search
CPC ..... G09G 3/3648; G09G 2300/0426; G09G 3/3614
USPC ..... 345/204
See application file for complete search history.

(56) References Cited

U.S. PATENT DOCUMENTS

2010/0110057 A1 * 5/2010 Lee et al. ..... 345/211

FOREIGN PATENT DOCUMENTS

| | | | |
|---|---|---|---|
| CN | 101620831 | | 1/2010 |
| CN | 101620831 A | * | 1/2010 |
| CN | 101853638 | | 10/2010 |
| CN | 101950108 A | * | 1/2011 |

OTHER PUBLICATIONS

State Intellectual Property Office of the People's Republic of China, "Office Action", Aug. 1, 2013.

* cited by examiner

*Primary Examiner* — Aneeta Yodichkas
*Assistant Examiner* — Neil Wood
(74) *Attorney, Agent, or Firm* — WPAT, PC; Justin King

(57) ABSTRACT

A dot inversion TFT array is provided. The dot inversion TFT array includes: a plurality of data lines; a plurality of dot unit pairs, each including a first dot unit and a second dot unit and coupled to one of the data lines; and a plurality of gate line pairs, each including a first gate line and a second gate line. A predetermined dot unit pair of the dot unit pairs is coupled to a predetermined gate line pair of the gate line pairs, and two horizontally neighboring dot unit pairs of the dot unit pairs are mirror-symmetrical.

13 Claims, 8 Drawing Sheets

DOT INVERSION TFT ARRAY AND LCD PANEL

This application claims the benefit of Taiwan application Serial No. 100101016, filed Jan. 11, 2011, the subject matter of which is incorporated herein by reference.

BACKGROUND OF THE INVENTION

1. Field of the Invention

The invention relates in general to a thin-film transistor (TFT) array and associated display panel, and more particularly to a dot inversion dual gate TFT array and associated LCD panel.

2. Description of the Related Art

FIG. 1 shows a schematic diagram of a conventional LCD panel. The LCD panel comprises a TFT array 100, a gate driver 120, a source driver 110, and a timing controller 130. The gate driver 120 and the source driver 110 control a plurality of dot units in the TFT array. The dot units are categorized into red dot units R, green dot units G, and blue dot units B. A combination of one red dot unit R, one green dot unit B, and one blue dot unit B forms a single pixel. The timing controller 130 generates a first timing control signal T1 to the gate driver 120, and a second timing control signal T2 to the source driver 110. Timings of gate driving signals and brightness signals respectively generated by the gate driver 120 and the source driver 110 are controlled by the timing controller 130.

Taking a 1280×768 resolution TFT array 100 for example, the TFT array 100 comprises 1280×768 pixels, i.e., each row of the TFT array is consisted of 1280 pixels. Therefore, the source driver 110 comprises 3840 (i.e., 1280×3) data lines respectively providing brightness signals to 3840 dot units.

The source driver 120 comprises 768 gate lines that in sequence generate gate driving signals to assert the 3840 dot units of corresponding rows. More specifically, in order to display a frame on the TFT array 100, there are 768 cycles, within each of which one gate line is asserted. There are 3840 dot units on one row for receiving brightness data of 3840 data lines. Accordingly, after 768 cycles, corresponding brightness signals are received by all dot units so as to display a complete frame.

To prolong a lifespan as well as reducing residual images of an LCD panel, it is desired that images be displayed on a TFT array using a dot inversion approach.

FIG. 2 shows a schematic diagram for controlling a conventional TFT array when displaying a frame. Each dot unit comprises a switch device and a transparent electrode. A control end of the switch device is coupled to and controlled by a gate line. When the switch device is closed, the transparent electrode is connected to a corresponding data line. Conversely, when the switch device is open, the transparent electrode is disconnected from the data line. For example, the transparent electrode is an indium tin oxide (ITO) electrode. The switch device is a TFT having its gate coupled to the gate line, whereas the TFT has its two other ends respectively coupled to the data line and the ITO electrode.

With reference to FIG. 2, an (n−1) gate line (Gn−1) is connected to a control end of an (n−1, m−1) dot unit, an (n−1, m) dot unit, and an (n−1, m+1) dot unit. An TFT M(n−1, m−1) is connected between an $(m-1)_{th}$ data line $D_{m-1}$ and an ITO electrode I(n−1, m−1); an TFT M(n−1, m) in the (n−1, m) dot unit is connected between an $(m)_{th}$ data line $D_m$ and an ITO electrode I(n−1, m); and an TFT M(n−1, m+1) in the (n−1, m+1) dot unit is connected between an $(m+1)_{th}$ data line $D_{m+1}$ and an ITO electrode I(n−1, m+1).

Further, an $n_{th}$ gate line $G_n$ is connected to a control end of an (n, m−1) dot unit, an (n, m) dot unit, and an (n, m+1) dot unit. An TFT M(n, m−1) in the (n, m−1) dot unit is connected between an (m−1) data line (Dm−1) and an ITO electrode I(n, m−1); an TFT M(n, m) in the (n, m) dot unit is connected between an (m) data line (Dm) and an ITO electrode I(n, m); and an TFT M(n, m+1) in the (n, m+1) dot unit is connected between an (m+1) data line (Dm+1) and an ITO electrode I(n, m+1).

Further, an $(n+1)_{th}$ gate line $G_{n+1}$ is connected to a control end of an (n+1, m−1) dot unit, an (n+1, m) dot unit, and an (n+1, m+1) dot unit. An TFT M(n+1, m−1) in the (n+1, m−1) dot unit is connected between an (m−1) data line $D_{m-1}$ and an ITO electrode I(n+1, m−1); an TFT M(n+1, m) in the (n+1, m) dot unit is connected between an $m_{th}$ data line $D_m$ and an ITO electrode I(n+1, m); and an TFT M(n+1, m+1) in the (n+1, m+1) dot unit is connected between an (m+1) data line (Dm+1) and an ITO electrode I(n+1, m+1).

As shown in FIG. 2, during an $(n-1)_{th}$ cycle $T_{n-1}$ when displaying a frame, the gate line $G_{n-1}$ is asserted. At this point, the data line $D_{m-1}$ provides brightness data of +a1 that is transmitted to the ITO I(n−1, m−1), the data line $D_m$ provides brightness data of −a2 that is transmitted to the ITO I(n−1, m), and the data line $D_{m+1}$ provides brightness data +a3 that is transmitted to the ITO I(n−1, m+1).

Similarly, during an $n_{th}$ cycle $T_n$ when displaying a frame, the gate line $G_n$ is asserted. Meanwhile, the data line $D_{m-1}$ provides brightness data of −b1 that is transmitted to the ITO I(n, m−1), the data line $D_m$ provides brightness data of +b2 that is transmitted to the ITO I(n, m), and the data line $D_{m+1}$ provides brightness data −b3 that is transmitted to the ITO I(n, m+1).

Similarly, during an $(n+1)_{th}$ cycle $T_{n+1}$ when displaying a frame, the gate line $G_{n+1}$ is asserted. Meanwhile, the data line $D_{m-1}$ provides brightness data of +c1 that is transmitted to the ITO I(n+1, m−1), the data line $D_m$ provides brightness data of −c2 that is transmitted to the ITO I(n+1, m), and the data line $D_{m+1}$ provides brightness data +c3 that is transmitted to the ITO I(n+1, m+1).

To achieve dot inversion of a TFT array, it is necessary that brightness signals of neighboring data lines on the source driver have opposite polarities, and polarities of brightness signals on one data line need to be appropriately adjusted. Accordingly, when the TFT array 100 displays a frame, the (n, m) dot unit is positive (+) while its neighboring dot units are negative (−); this is referred to as dot inversion.

FIG. 3 shows a schematic diagram showing signals of a conventional TFT array with virtual dot inversion. During an $(n-1)_{th}$ cycle $T_{n-1}$, polarities of the first data line to the last data line are in sequence {(+), (−), (+), (−), . . . , (+), (−)}. During an $n_{th}$ cycle $T_n$, polarities of the first data line to the last data line are in sequence {(−), (+), (−), . . . , (−), (+)}. During an $(n+1)_{th}$ cycle $T_{n+1}$, polarities of the first data line to the last data line are in sequence {(+), (−), (+), (−), . . . , (+), (−)}, and so forth.

Due to the increase in the size of LCD panels, the number of data lines on a source driver also gets larger and larger. Therefore, to reduce the amount of data lines on a source driver, a dual gate TFT array is proposed. Taking a 1280×768 resolution TFT array for example, the number of data lines of a source driver is halved to 1920 and the number of gate lines of a gate driver is doubled to 1536 in a dual gate TFT array compared to those in the TFT array shown in FIG. 1.

Nevertheless, a driving method associated with the prior art applied to a dual gate TFT array is incompetent in achieving complete dot inversion.

SUMMARY OF THE INVENTION

The invention is directed to a TFT array and associated control method, which displays an image with a dot inversion approach by implementing a dual gate TFT array driven by same gate driving signals and source driving signals.

According to an aspect of the present invention, a complete dot inversion TFT array comprises: a plurality of data lines; a plurality of dot unit pairs, each comprising a first dot unit and a second dot unit, and coupled to one of the data lines; and a plurality of gate line pairs, each comprising a first gate line and a second gate line. A predetermined dot unit pair of the dot unit pairs is coupled to a predetermined gate line pair of the gate line pairs, and two horizontally neighboring dot unit pairs of the dot unit pairs are mirror-symmetrical.

According to another aspect of the present invention, a dot inversion TFT array is provided. The dot inversion TFT array comprises: an $m_{th}$ data line; an $(m+1)_{th}$ data line; an $n_{th}$ gate line pair, comprising a first gate line and a second gate line; a $(2m-1)_{th}$ dot unit, comprising a control end connected to the first gate line and a data receiving end connected to the $m_{th}$ data line; a $(2m)_{th}$ dot unit, comprising a control end connected to the second gate line and a data receiving end connected to the $m_{th}$ data line; a $(2m+1)_{th}$ dot unit, comprising a control end connected to the second gate line and a data receiving end connected to the $(m+1)_{th}$ data line; and a $(2m+2)_{th}$ dot unit, comprising a control end connected to the first gate line and a data receiving end connected to the $(m+1)_{th}$ data line. The $(2m-1)_{th}$ dot unit, the $(2m)_{th}$ dot unit, the $(2m+1)_{th}$ dot unit, and the $(2m+2)_{th}$ dot unit are arranged in sequence on an $n_{th}$ row.

According to yet another aspect of the present invention, an LCD panel is provided. The LCD panel comprises: a timing controller, for generating a first timing signal and a second timing signal; a gate driver, for receiving the first timing signal to generate a plurality of gate driving signals; a source driver, for receiving the second timing signal to generate a plurality of brightness signals; and a TFT array, comprising a plurality of data lines connected to the source driver to receive the brightness signals, a plurality of dot unit pairs, each comprising a first dot unit and a second dot unit and connected to one of the data lines, and a plurality of gate lines connected to the gate driver to receive the gate driving signals. A predetermined dot unit pair of the dot unit pairs is coupled to a predetermined gate line pair of the gate line pairs, and two horizontally neighboring dot unit pairs of the dot unit pairs are mirror-symmetrical.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
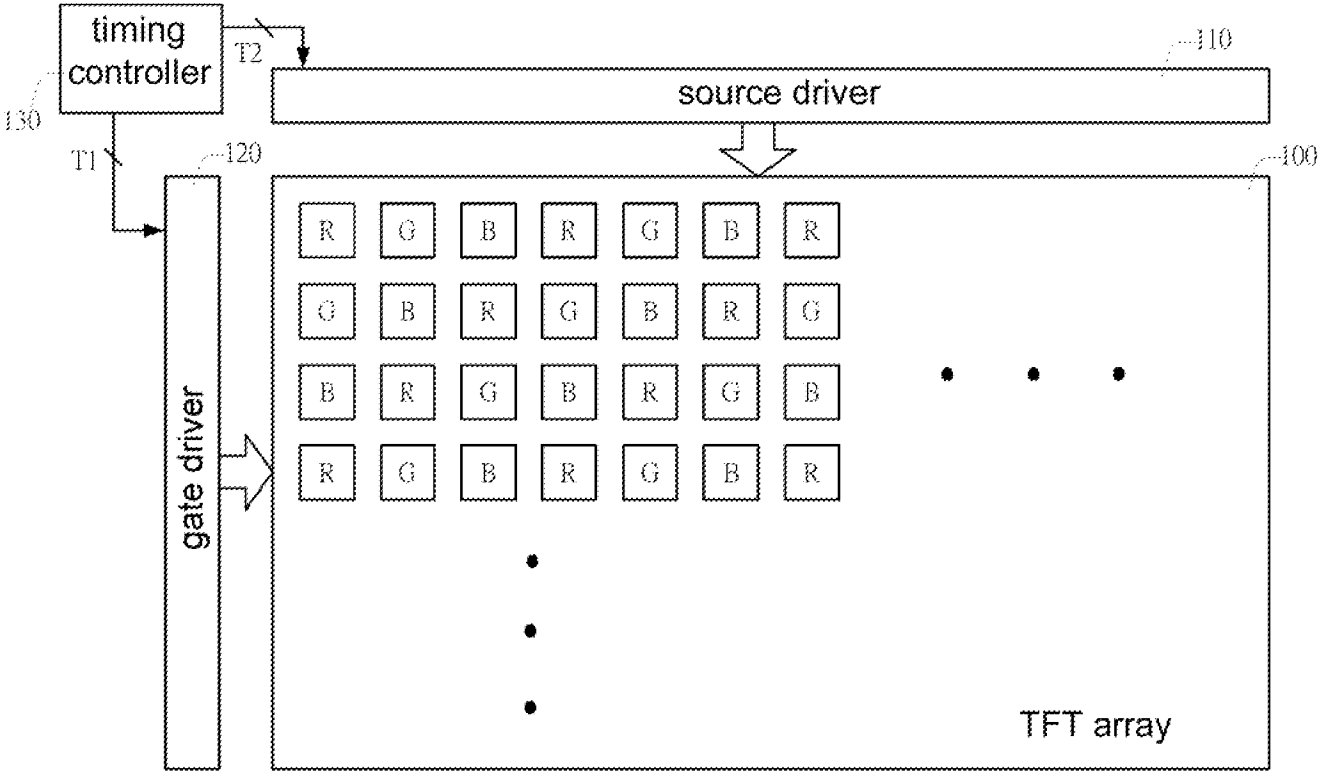
FIG. 1 (Prior Art)
FIG. 1 is a schematic diagram of an LCD panel.
Figure 2:
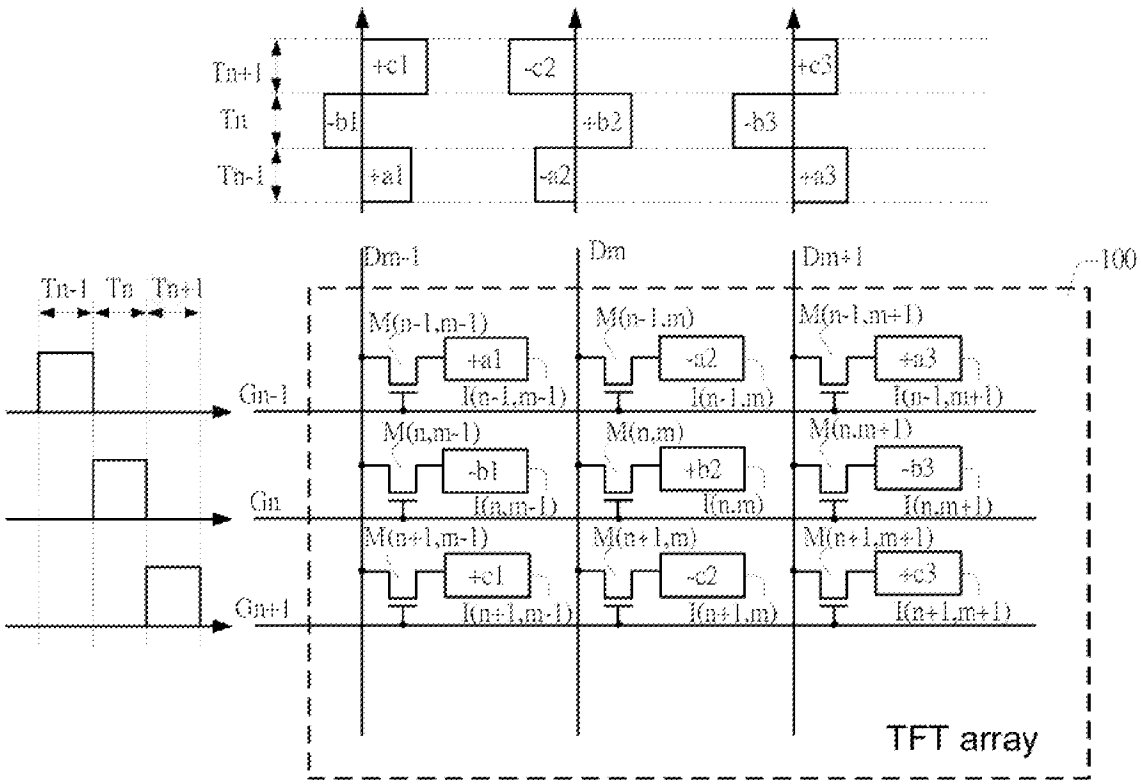
FIG. 2 (Prior Art)
FIG. 2 is a schematic diagram for controlling a TFT array when displaying a frame.
Figure 3:
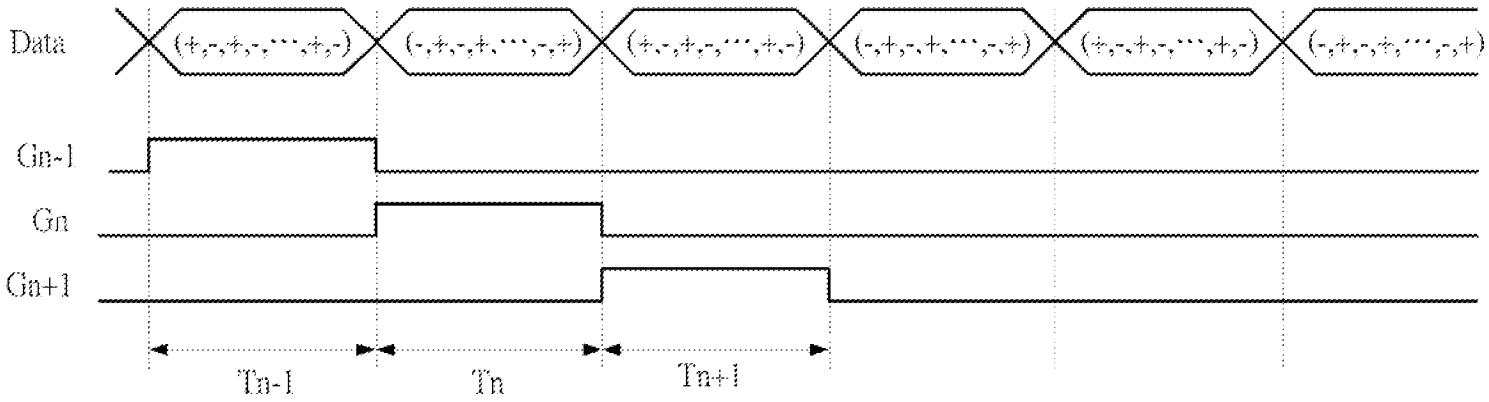
FIG. 3 (Prior Art)
FIG. 3 shows a schematic diagram of signals for a dot inversion TFT array.
Figure 4:
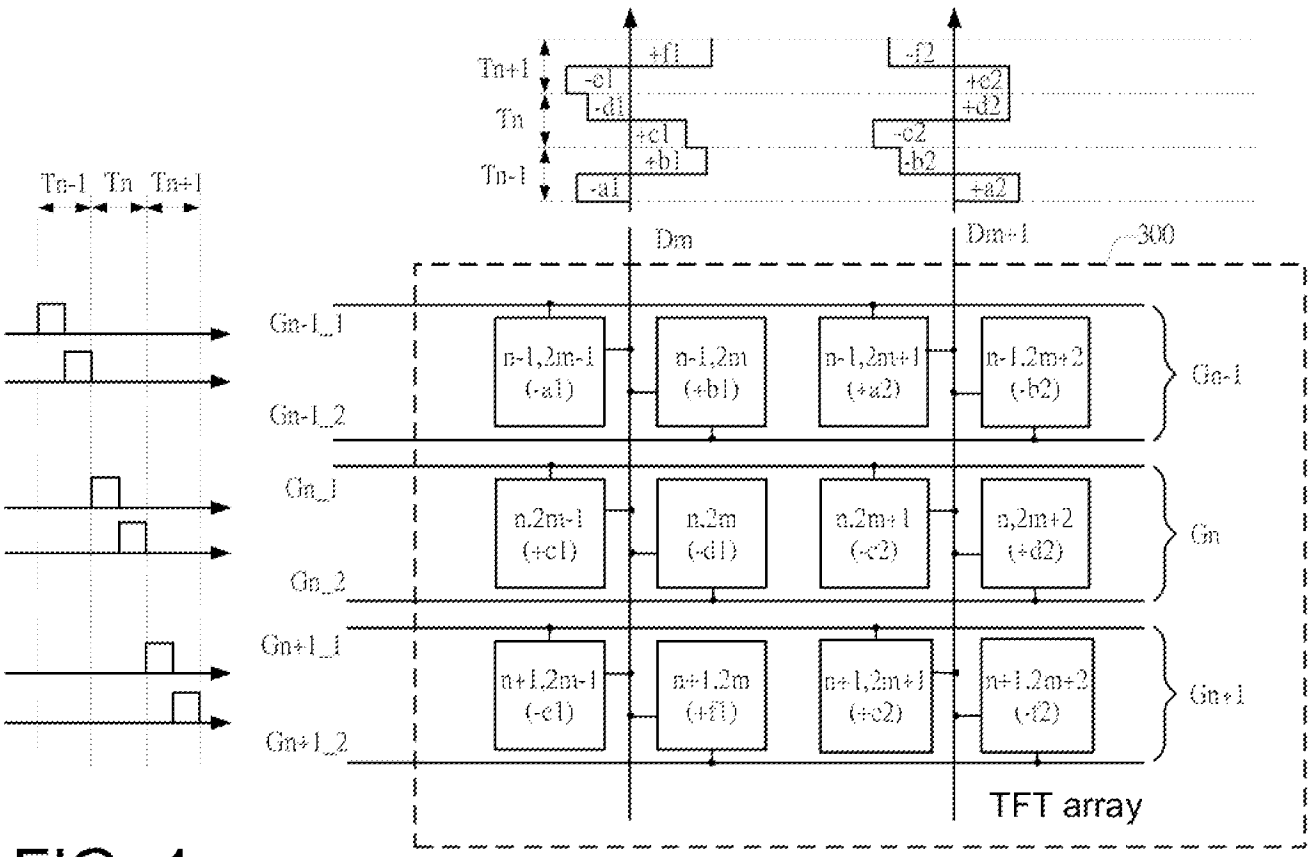
FIG. 4 is a structural schematic diagram of a dual gate TFT array.

FIG. 4 shows a schematic diagram of a dual gate TFT array. A TFT array 300 comprises an $(n-1)_{th}$ gate line pair $G_{n-1}$, an $n_{th}$ gate line pair $G_n$, an $(n+1)_{th}$ gate line pair $G_{n+1}$, an $m_{th}$ data line $D_m$, and an $(m+1)_{th}$ data line $D_{m+1}$. The $(n-1)_{th}$ gate line pair $G_{n-1}$ controls (n−1, 2m−1) dot unit, an (n−1, 2m) dot unit, an (n−1, 2m+1) dot unit, and an (n−1, 2m+2) dot unit on an (n−1) row; the (n−1, 2m−1) dot unit and the (n−1, 2m) dot unit are connected to the data line $D_m$, and the (n−1, 2m+1) dot unit and the (n−1, 2m+2) dot unit are connected to the data line $D_{m+1}$. The gate line pair $G_n$ controls an (n, 2m−1) dot unit, an (n, 2m) dot unit, an (n, 2m+1) dot unit, and an (n, 2m+2) dot unit on an $n_{th}$ row. The (n, 2m−1) dot unit and the (n, 2m) dot unit are connected to the data line $D_m$, and the (n, 2m+1) dot unit and the (n, 2m+2) dot unit are connected to the data line $D_{m+1}$. The gate line pair $G_{n+1}$ controls (n+1, 2m−1) dot unit, an (n+1, 2m) dot unit, an (n+1, 2m+1) dot unit, and an (n+1, 2m+2) dot unit on an $(n+1)_{th}$ row. The (n+1, 2m−1) dot unit and the (n+1, 2m) dot unit are connected to the data line $D_m$, and the (n+1, 2m+1) dot unit and the (n+1, 2m+2) dot unit are connected to the data line $D_{m+1}$.

As shown in FIG. 4, the odd dot units in each row are controlled by the first gate line in the gate line pair, and the even dot units are controlled by the second gate line in the gate line pair. For example, in the $(n-1)_{th}$ row, a first gate line $G_{n-1_1}$ in the gate line pair $G_{n-1}$ controls the (n−1, 2m−1) dot unit and the (n−1, 2m+1) dot unit. A second gate line $G_{n-1_2}$ in the gate line pair $G_{n-1}$ controls the (n−1, 2m) dot unit and the (n−1, 2m+2) dot unit. Similarly, in the $n_{th}$ row, a first gate line $G_{n_1}$ in the gate line pair $G_n$ controls the (n, 2m−1) dot unit and the (n, 2m+1) dot unit. A second gate line $G_{n_2}$ in the gate line pair $G_n$ controls the (n, 2m) dot unit and the (n, 2m+2) dot unit. Further, in the $(n+1)_{th}$ row, a first gate line $G_{n+1_1}$ in the gate line pair $G_{n+1}$ controls the (n+1, 2m−1) dot unit and the (n+1, 2m+1) dot unit; a second gate line $G_{n+1_2}$ in the gate line pair $G_{n+1}$ controls the (n+1, 2m) dot unit and the (n+1, 2m+2) dot unit.

Please refer to FIG. 4, where an $(n-1)_{th}$ cycle $T_{n-1}$ is divided into front and rear sub-cycles for respectively asserting the first gate line $G_{n-1_1}$ and the second gate line $G_{n-1_2}$ in the gate line pair $G_{n-1}$. An $n_{th}$ cycle $T_n$ is divided into front and rear sub-cycles for respectively asserting the first gate line $G_{n_1}$ and the second gate line $G_{n_2}$ in the gate line pair $G_n$. An $(n+1)_{th}$ cycle $T_{n+1}$ is divided into front and rear sub-cycles for respectively asserting the first gate line $G_{n+1_1}$ and the second gate line $G_{n+1_2}$ in the gate line pair $G_{n+1}$.

As indicated in FIG. 4, polarities of brightness signals outputted from neighboring data lines on the source driver are different. On the data line $D_m$, a −a1 brightness signal is provided during a front sub-cycle of the cycle $T_{n-1}$, and a +b1 brightness signal is provided during a rear sub-cycle of the cycle $T_{n-1}$; a +c1 brightness signal is provided during a front sub-cycle of the cycle $T_n$, and a −d1 brightness signal is provided during a rear sub-cycle of the cycle $T_n$; a −e1 brightness signal is provided during a front sub-cycle of the cycle $T_{n+1}$, and a +f1 brightness signal is provided during a rear sub-cycle of the cycle $T_{n+1}$. Further, on the data line $D_{m+1}$, a +a2 brightness signal is provided during a front sub-cycle of the cycle $T_{n-1}$, and a −b2 brightness signal is provided during a rear sub-cycle of the cycle $T_{n-1}$; a −c2 brightness signal is provided during a front sub-cycle of the cycle $T_n$, and a +d2 brightness signal is provided during a rear sub-cycle of the cycle $T_n$; a +e2 brightness signal is provided during a front sub-cycle of the cycle $T_{n+1}$, and a −f2 brightness signal is provided during a rear sub-cycle of the cycle $T_{n+1}$.

Figure 5:
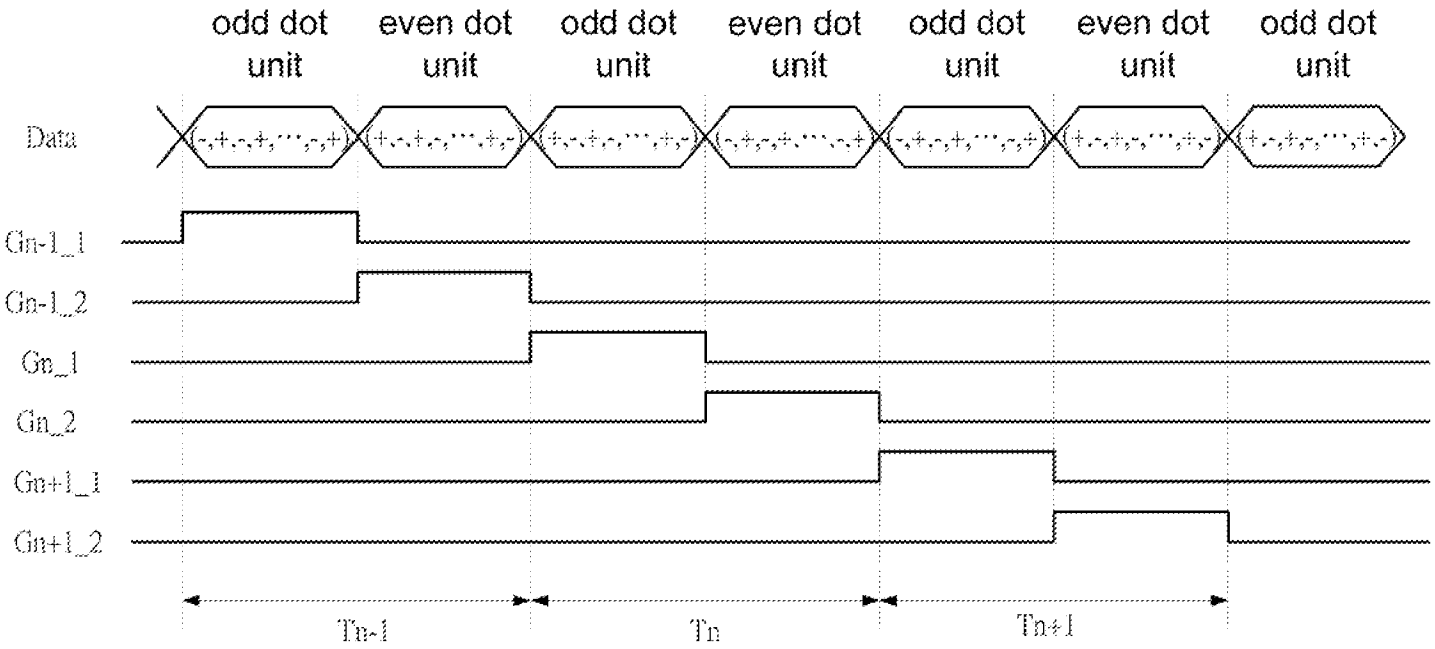
FIG. 5 is a schematic diagram of signals of a dual gate TFT array.

FIG. 5 shows a diagram of signals for a dual gate TFT array. During the front sub-cycle of the cycle $T_{n-1}$, polarities of a first data line to a last data line are respectively {(−), (+), (−), (+), . . . , (−), (+)}. The odd dot units of the gate line pair $G_{n-1}$ in sequence receive polarities of the brightness data. During the rear sub-cycle of the cycle $T_{n-1}$, polarities of the first data line to the last data line are respectively {(+), (−), (+), (−), . . . , (+), (−)}. The even dot units of the gate line pair $G_{n-1}$ in sequence receive polarities of the brightness data. During the front sub-cycle of the cycle $T_n$, polarities of a first data line to a last data line are respectively {(+), (−), (+), (−), . . . , (+), (−)}. The odd dot units of the gate line pair $G_n$ in sequence receive polarities of the brightness data. During the rear sub-cycle of the cycle $T_n$, polarities of the first data line to the last data line are respectively {(−), (+), (−), (+), . . . , (−), (+)}. The even dot units of the gate line pair $G_n$ in sequence receive polarities of the brightness data. During the front sub-cycle of the cycle $T_{n+1}$, polarities of a first data line to a last data line are respectively {(−), (+), (−), (+), . . . , (−), (+)}. The odd dot units of the gate line pair $G_{n+1}$ in sequence receive polarities of the brightness data; during the rear sub-cycle of the cycle $T_{n+1}$, polarities of the first data line to the last data line are respectively {(+), (−), (+), (−), . . . , (+), (−)}. The even dot units of the gate line pair $G_{n+1}$ in sequence receive polarities of the brightness data. Polarities in following cycles can be deduced accordingly.

The driving scheme applied in the dual gate TFT array described above fails to achieve complete dot inversion. Polarities of a random dot unit and its neighboring dot unit are not entirely opposite. Taking the (n, 2m) dot unit for example, out of its four neighboring dot units namely the (n, 2m−1) dot unit, the (n, 2m+1) dot unit, the (n−1, 2m) dot unit, and the (n+1, 2m) dot unit, the polarity of the (n, 2m+1) dot unit is the same as that of the (n, 2m) dot unit.

Figure 6:
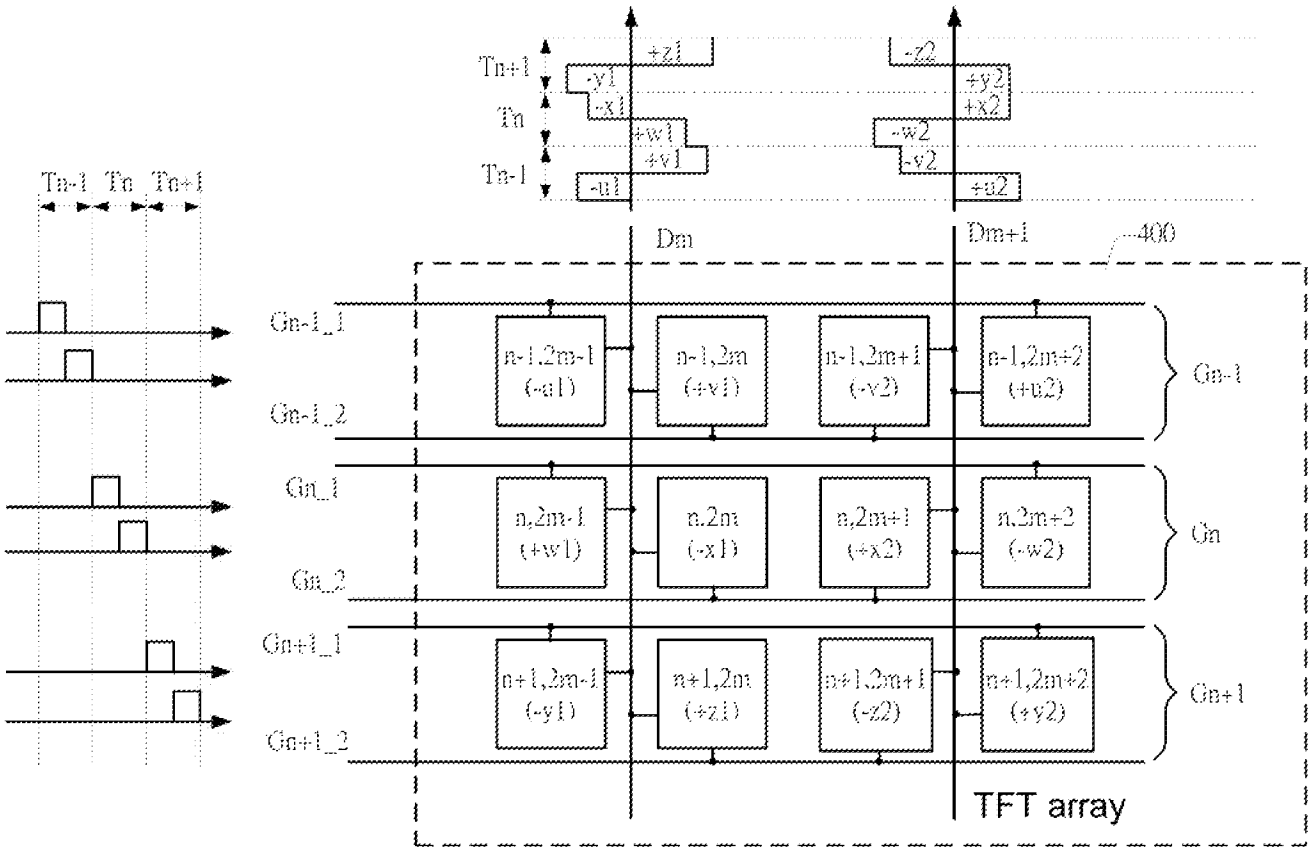
FIG. 6 is a schematic diagram of a dual TFT array according to an embodiment of the present invention.

FIG. 6 shows a schematic diagram of a dual gate TFT array according to an embodiment of the present invention. A TFT array 400 comprises an $(n-1)_{th}$ gate line pair $G_{n-1}$, an $n_{th}$ gate line pair $G_n$, an $(n+1)_{th}$ gate line pair $G_{n+1}$, an $m_{th}$ data line $D_m$, and an $(m+1)_{th}$ data line $D_{m+1}$. The $(n-1)_{th}$ gate line pair controls (n−1, 2m−1) dot unit, an (n−1, 2m) dot unit, an (n−1, 2m+1) dot unit, and an (n−1, 2m+2) dot unit on an $(n-1)_{th}$ row; the (n−1, 2m−1) dot unit and the (n−1, 2m) dot unit are connected to the data line $D_m$, and the (n−1, 2m+1) dot unit and the (n−1, 2m+2) dot unit are connected to the data line $D_{m+1}$. The gate line pair $G_n$ controls (n, 2m−1) dot unit, an (n, 2m) dot unit, an (n, 2m+1) dot unit, and an (n, 2m+2) dot unit on an $n_{th}$ row; the (n, 2m−1) dot unit and the (n, 2m) dot unit are connected to the data line $D_m$, and the (n, 2m+1) dot unit and the (n, 2m+2) dot unit are connected to the data line $D_{m+1}$. The gate line pair $G_{n+1}$ controls (n+1, 2m−1) dot unit, an (n+1, 2m) dot unit, an (n+1, 2m+1) dot unit, and an (n+1, 2m+2) dot unit on an $(n+1)_{th}$ row; the (n+1, 2m−1) dot unit and the (n+1, 2m) dot unit are connected to the data line $D_m$, and the (n+1, 2m+1) dot unit and the (n+1, 2m+2) dot unit are connected to the data line $D_{m+1}$.

As shown in FIG. 6, the (2m−1) dot unit and the (2m+2) dot unit in each row are controlled by the first gate line in the gate line pair, and the (2m) dot unit and the (2m+1) dot unit are controlled by the second gate line in the gate line pair. For example, in the $(n-1)_{th}$ row, a first gate line $G_{n-1_1}$ in the gate line pair $G_{n-1}$ controls the (n−1, 2m−1) dot unit and the (n−1, 2m+2) dot unit; a second gate line $G_{n-1_2}$ in the gate line pair $G_{n-1}$ controls the (n−1, 2m) dot unit and the (n−1, 2m+1) dot unit. Similarly, in the $n_{th}$ row, a first gate line $G_{n_1}$ in the gate line pair $G_n$ controls the (n, 2m−1) dot unit and the (n, 2m+2) dot unit. A second gate line $G_{n_2}$ in the gate line pair $G_n$ controls the (n, 2m) dot unit and the (n, 2m+1) dot unit. Further, in the $(n+1)_{th}$ row, a first gate line $G_{n+1_1}$ in the gate line pair $G_{n+1}$ controls the (n+1, 2m−1) dot unit and the (n+1, 2m+2) dot unit. A second gate line $G_{n+1_2}$ in the gate line pair $G_{n+1}$ controls the (n+1, 2m) dot unit and the (n+1, 2m+1) dot unit.

Again referring to FIG. 6, an $(n-1)_{th}$ cycle $T_{n-1}$ is divided into front and rear sub-cycles for respectively asserting the first gate line $G_{n-1_1}$ and the second gate line $G_{n-1_2}$ in the gate line pair $G_{n-1}$. An $n_{th}$ cycle $T_n$ is divided into front and rear sub-cycles for respectively asserting the first gate line $G_{n_1}$ and the second gate line $G_{n_2}$ in the gate line pair $G_n$. An $(n+1)_{th}$ cycle $T_{n+1}$ is divided into front and rear sub-cycles for respectively asserting the first gate line $G_{n+1_1}$ and the second gate line $G_{n+1_2}$ in the gate line pair $G_{n+1}$.

As indicated in FIG. 6, polarities of brightness signals outputted from neighboring data lines on the source driver are different. On the $m_{th}$ data line $D_m$, a −u1 brightness signal is provided during a front sub-cycle of the cycle $T_{n-1}$, and a +v1 brightness signal is provided during a rear sub-cycle of the cycle $T_{n-1}$; a +w1 brightness signal is provided during a front sub-cycle of the cycle $T_n$, and a −x1 brightness signal is provided during a rear sub-cycle of the cycle $T_n$; a −y1 brightness signal is provided during a front sub-cycle of the cycle $T_{n+1}$, and a +z1 brightness signal is provided during a rear sub-cycle of the cycle $T_{n+1}$. Further, on the $(m+1)_{th}$ data line $D_{m+1}$, a +u2 brightness signal is provided during a front sub-cycle of the cycle $T_{n-1}$, and a −v2 brightness signal is provided during a rear sub-cycle of the cycle $T_{n-1}$. A −w2 brightness signal is provided during a front sub-cycle of the cycle $T_n$, and a +x2 brightness signal is provided during a rear sub-cycle of the cycle $T_n$. A +y2 brightness signal is provided during a front sub-cycle of the cycle $T_{n+1}$, and a −z2 brightness signal is provided during a rear sub-cycle of the cycle $T_{n+1}$.

Figure 7:
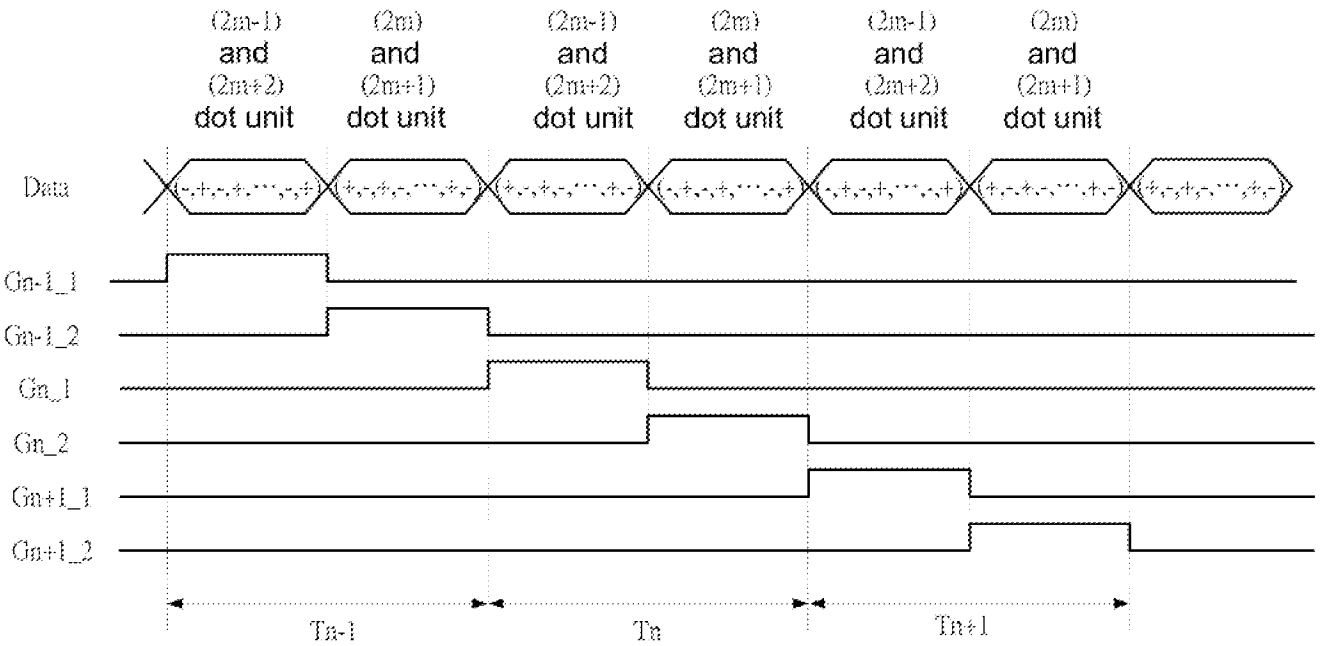
FIG. 7 shows a schematic diagram of signals for a dual TFT array according to an embodiment of the present invention.

FIG. 7 shows a diagram of signals for a dual gate TFT array according to an embodiment of the present invention. During the front sub-cycle of the cycle $T_{n-1}$, polarities of a first data line to a last data line are respectively {(−), (+), (−), (+), . . . , (−), (+)}, meaning that the (2m−1) and (2m+2) dot units of the gate line pair $G_{n-1}$ in sequence receive polarities of the brightness data, where m and n are integers greater than 1. During the rear sub-cycle of the cycle $T_{n-1}$, polarities of the first data line to the last data line are respectively {(+), (−), (+), (−), . . . , (+), (−)}, meaning that the (2m) and (2m+1) dot units of the gate line pair $G_{n-1}$ in sequence receive polarities of the brightness data, where m and n are integers greater than 1. During the front sub-cycle of the cycle $T_n$, polarities of a first data line to a last data line are respectively {(+), (−), (+), (−), . . . , (+), (−)}, meaning that the (2m−1) and (2m+2) dot units of the gate line pair $G_n$ in sequence receive polarities of the brightness data; during the rear sub-cycle of the cycle $T_n$, polarities of the first data line to the last data line are respectively {(−), (+), (−), (+), . . . , (−), (+)}, meaning that the (2m) and (2m+1) dot units of the gate line pair $G_n$ in sequence receive polarities of the brightness data. During the front sub-cycle of the cycle $T_{n+1}$, polarities of a first data line to a last data line are respectively {(−), (+), (−), (+), . . . , (−), (+)}, meaning that the (2m−1) and (2m+2) dot units of the gate line pair $G_n$ in sequence receive polarities of the brightness data; during the rear sub-cycle of the cycle $T_{n+1}$, polarities of the first data line to the last data line are respectively {(+), (−), (+), (−), . . . , (+), (−)}, meaning that the (2m) and (2m+1) dot units of the gate line pair $G_{n+1}$ in sequence receive polarities of the brightness data. Polarities in following cycles can be deduced accordingly.

As observed from FIG. 6, when the gate line pair $G_{n-1}$ is asserted, polarities of the four dot units on the row are in sequence "−", "+", "−", "+"; when the gate line pair $G_n$ is asserted, polarities of the four dot units on the row are in sequence "+", "−", "+", "−". It is appreciated that the dual gate TFT array and corresponding brightness signals according to the invention are capable of displaying a frame with dot inversion.

Therefore, a dot inversion TFT array of the present invention comprises a plurality of data lines, a plurality of dot unit pairs and a plurality of gate line pairs. For example, each of the dot unit pairs is the (n−1, 2m−1) dot unit and the (n−1, 2m) dot unit in FIG. 6, or the (n−1, 2m+1) dot unit and the (n−1, 2m+2) dot unit in FIG. 6. Each of the dot unit pair comprises a first dot unit and a second dot unit, and is connected to one of the data lines. Each of the gate line pairs comprises a first gate line and a second gate line. A predetermined dot unit pair of the dot unit pairs is coupled to the first gate line and the second gate line of a predetermined gate line pair of the gate line pairs. Two horizontally neighboring dot unit pairs of the dot unit pairs have a mirror-symmetrical circuit layout, and two vertically neighboring dot unit pairs of the dot unit pairs have an identical circuit layout. The first dot unit and the second dot unit of each of the dot unit pairs are respectively coupled to the first gate line and the second gate line of the predetermined gate line pair. The TFT array further comprises a source driver and a gate driver. The source driver is connected to the data lines, and the gate driver is connected to the gate line pairs. During a predetermined cycle, the first gate line and the second gate line of one of the gate line pairs are in sequence asserted, so that the first dot unit of the predetermined dot unit pair of the dot unit pairs receives a brightness signal of a first polarity, and the second dot unit of the predetermined dot unit pair receives a brightness signal of a second polarity; wherein the first polarity differs from the second polarity.

Figure 8:
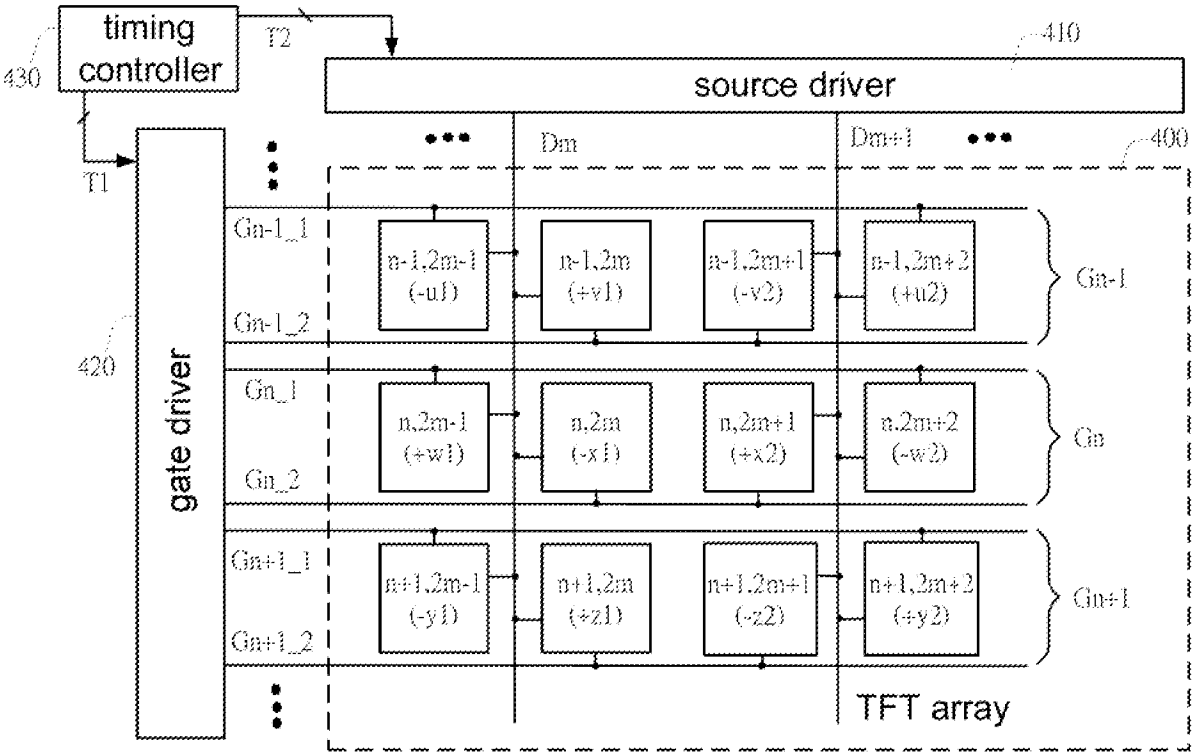
FIG. 8 is a schematic diagram of an LCD panel according to an embodiment of the present invention.

FIG. 8 shows a schematic diagram of an LCD panel according to an embodiment of the present invention. The LCD panel comprises a TFT array 400, a source driver 410, a gate driver 420, and a timing controller 430. The source driver 410 is connected to data lines of the TFT array 400 to output brightness signals; the gate driver 420 is connected to a plurality of gate lines of the TFT array 400 to drive gate driving signals; and the timing controller 430 generates a first timing control signal T1 to the gate driver 420 and a second timing control signal T2 to the source driver 410. That is, the gate driving signals and the brightness signals respectively generated by the gate driver 420 and the source driver 410 are controlled by the timing controller 430.

With description of the embodiments, it is appreciated that a dot inversion TFT array and associated LCD panel is provided by the present invention, where the TFT array displays image with dot inversion.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dot inversion TFT array, comprising:

a first data line;

a second data line, adjacent and parallel to said first data line;

a first gate line;

a second gate line, adjacent and parallel to said first gate line;

a first dot unit pair, comprising:

a first dot unit, coupled to said first data line and coupled to said first gate line; and a second dot unit, coupled to said first data line and coupled to said second gate line; and a second dot unit pair, comprising:

a third dot unit, coupled to said second data line and coupled to said second gate line; and a fourth dot unit, coupled to said second data line and coupled to said first gate line;

wherein said second dot unit is positioned between said first dot unit and said third dot unit, said third dot unit is positioned between said second dot unit and said fourth dot unit, said first dot unit receives a first brightness signal of a first polarity from said first data line during a first time frame, said second dot unit receives a second brightness signal of a second polarity from said first data line during a second time frame, said third dot unit receives a third brightness signal of said first polarity from said second data line during said second time frame, said fourth dot unit receives a fourth brightness signal of said second polarity from said second data line during said first time frame, and said first polarity differs from said second polarity.

2. The TFT array according to claim 1, wherein two vertically neighboring dot unit pairs of the plurality of dot unit pairs coupled to a shared data line are identical.

3. The TFT array according to claim 1, further comprising a source driver connected to the data lines.

4. The TFT array according to claim 1, further comprising a gate driver connected to the first gate line and the second gate line.

5. The TFT array according to claim 1, wherein the first gate line and the second gate line are in sequence asserted within a predetermined cycle.

6. A dot inversion TFT array, comprising:

an mth data line;

an (m+1)th data line;

an nth gate line pair, comprising a first gate line and a second gate line;

a (2m−1)th dot unit, comprising a (2m−1)th control end connected to the first gate line and a (2m−1)th data receiving end connected to the mth data line;

a (2m)th dot unit, comprising a (2m)th control end connected to the second gate line and a (2m)th data receiving end connected to the mth data line as said (2m−1)th dot unit;

a (2m+1)th dot unit, comprising a (2m+1)th control end connected to the second gate line and a (2m+1)th data receiving end connected to the (m+1)th data line; and a (2m+2)th dot unit, comprising a (2m+2)th control end connected to the first gate line and a (2m+2)th data receiving end connected to the (m+1)th data line as said (2m+1)th dot unit;

wherein, the (2m−1)th dot unit, the (2m)th dot unit, the (2m+1)th dot unit and the (2m+2)th dot unit are arranged in sequence on an nth row, where m and n are integers greater than 1, said (2m−1)th dot unit and said (2m+2)th dot unit receive brightness signals with different polarities from said mth data line and said (m+1)th data line respectively, and said (2m)th dot unit and said (2m+1)th dot unit receive brightness signals with different polarities from said mth data line and said (m+1)th data line respectively.

7. The TFT array according to claim 6, further comprising a source driver connected to the mth data line and the (m+1)th data line.

8. The TFT array according to claim 6, further comprising a gate driver connected to the nth gate line pair.

9. The TFT array according to claim 6, wherein the first gate line and the second gate line of the nth gate line pair are in sequence asserted within an nth cycle.

10. An LCD panel, comprising:

a timing controller, for generating a first timing signal and a second timing signal;

a gate driver, for receiving the first timing signal to generate a plurality of gate driving signals;

a source driver, for receiving the second timing signal to generate a plurality of brightness signals; and a TFT array, comprising:

a plurality of data lines, extending along a first axis, connected to the source driver to receive the brightness signals;

a plurality of dot unit pairs, each comprising a first dot unit and a second dot unit, each coupled to a same one of the data lines; and a plurality of gate line pairs, extending along a second axis perpendicular to the first axis, each gate line pair comprising a first gate line connected to the gate driver and a second gate line connected to the gate driver;

wherein each dot unit pair is coupled to the first gate line and the second gate line of a predetermined gate line pair of the plurality of gate line pairs, and each dot unit pair has an alternating gate line connection sequence to an adjacent dot unit pair along the second axis, the first dot unit of a predetermined dot unit pair of the dot unit pairs receives a first brightness signal of a first polarity of said plurality of brightness signals by a first data line of said plurality of data lines, the second dot unit of the predetermined dot unit pair receives a second brightness signal of a second polarity of said plurality of brightness signals by said first data line, and said first polarity differs from said second polarity.

11. The LCD panel according to claim 10, wherein two vertically neighboring dot units of the dot units are identical.

12. The LCD panel according to claim 10, wherein the first gate line and the second gate line of a predetermined gate line of the gate line pairs are in sequence asserted within a predetermined cycle.

13. The LCD panel according to claim 10, wherein the TFT array comprises:

an mth data line and an (m+1)th data line;

an nth gate line pair of the gate line pairs, the nth gate line pair comprising a first gate line and a second gate line;

a first dot unit pair, comprising a (2m−1)th dot unit comprising a (2m−1)th control end connected to the first gate line and a (2m−1)th data receiving end connected to the mth data line, and a (2m)th dot unit comprising a (2m)th control end connected to the second gate line and a (2m)th data receiving end connected to the mth data line; and a second dot unit pair, comprising a (2m+1)th dot unit comprising a (2m+1)th control end connected to the first gate line and a (2m+1)th data receiving end connected to the (m+1)th data line, and a (2m+2)th dot unit comprising a (2m+2)th control end connected to the second gate line and a (2m+2)th data receiving end connected to the (m+1)th data line;

wherein, the (2m−1)th dot unit, the (2m)th dot unit, the (2m+1)th dot unit and the (2m+2)th dot unit are arranged in sequence on an (n) row, where m and n are integers greater than 1.

* * * * *